United States Patent [19]

Huffman

[11] 4,422,290

[45] Dec. 27, 1983

[54] HYDRAULIC CONTROL SYSTEM FOR GOVERNING STEERING AND IMPLEMENT ACTUATORS

[75] Inventor: Theron M. Huffman, Paw Paw, Mich.

[73] Assignee: General Signal, Stamford, Conn.

[21] Appl. No.: 296,282

[22] Filed: Aug. 26, 1981

[51] Int. Cl.[3] ..... F15B 13/06; F15B 13/09; F15B 20/00

[52] U.S. Cl. ..... 60/404; 60/405; 60/418; 60/422; 60/430; 180/133

[58] Field of Search ..... 60/404, 405, 418, 422, 60/430; 91/516; 137/596; 180/133

[56] References Cited

U.S. PATENT DOCUMENTS

| | | | |
|---|---|---|---|
| 3,355,994 | 12/1967 | Malott | 60/422 |
| 3,535,877 | 10/1970 | Becker et al. | 60/422 |
| 3,913,324 | 10/1975 | Miller et al. | 60/405 |
| 3,952,510 | 4/1976 | Peterson | 60/430 X |
| 3,976,158 | 8/1976 | Shaffer | 60/418 X |
| 4,002,220 | 1/1977 | Wible | 60/422 X |
| 4,044,786 | 8/1977 | Yip | 60/422 X |
| 4,076,096 | 2/1978 | Hushower et al. | 180/133 |
| 4,190,130 | 2/1980 | Beck | 60/405 X |
| 4,215,720 | 8/1980 | Becker | 91/516 X |
| 4,337,620 | 7/1982 | Johnson | 60/418 |

*Primary Examiner*—Gerald A. Michalsky
*Attorney, Agent, or Firm*—Thomas R. FitzGerald; Harold S. Wynn

[57] ABSTRACT

Implement and steering actuators are selectively actuated through steering and implement control valves respectively by fluid power output of respective steering and implement pumps. A pressure compensator is provided for at times diverting excess fluid from the steering pump to the implement control valve, and the implement pump applies fluid pressure to the implement valve through an unloading valve that gives the charging of an accumulator by the implement pump preference over operation of the implement actuator. The sensing of loss of fluid power in the steering pump activates an emergency control valve to connect the accumulator to the steering valve and to disconnect the pressure compensator from the implement control valve.

3 Claims, 1 Drawing Figure

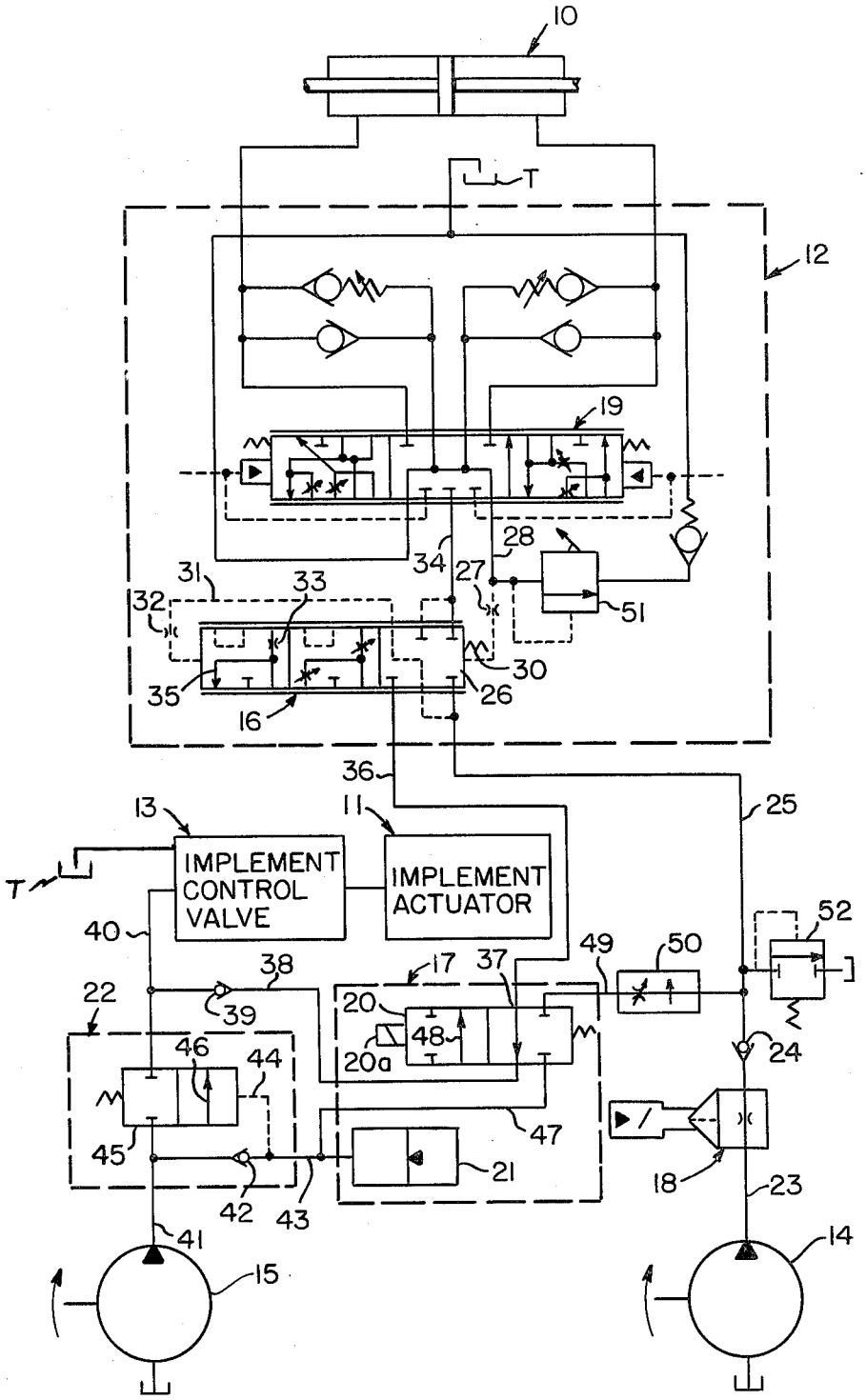
10
T
12
19
28
34
27
51
31
33
32
30
35
26
16
36
25
13
11
IMPLEMENT CONTROL VALVE
IMPLEMENT ACTUATOR
T
52
40
49
50
38
17
37
22
39
20
48
20a
24
46
44
47
45
21
18
23
42
43
41
14
15

HYDRAULIC CONTROL SYSTEM FOR GOVERNING STEERING AND IMPLEMENT ACTUATORS

REFERENCE TO PRIOR CASES

This invention relates to prior U.S. Pat. No. 4,215,720, which is assigned to the same assignee as the present invention, and to the U.S. Pat. No. 4,190,130. These patents are incorporated herein by reference for a better understanding of the background of the present invention.

BACKGROUND OF THE INVENTION

The present invention relates to hydraulic control systems for steering and implement actuators for off-highway vehicles, and it more particularly relates to emergency steering operation in case of failure of a steering pump to deliver sufficient fluid power.

In hydraulic control systems for off-highway vehicles having hydraulic steering and hydraulic control of implement, it is desirable to have a standby emergency steering system as is provided by the U.S. Pat. No. 4,190,130, for example, to ensure that the vehicle steering will remain under operator control, at least for a time interval, after failure of a normal hydraulic steering system. This emergency apparatus is normally inactive and serves no useful purpose except under conditions where emergency steering is required, and the normal hydraulic system is used primarily just while the vehicle is in motion.

To make more efficient use of the hydraulic power developed for the steering system, according to the U.S. Pat. No. 4,215,720, a pressure compensator senses the normal hydraulic steering load, and makes any excess fluid power output of a steering pump available for control of an implement. The system according to this patent is primarily for light equipment where a single pump can be used for both implement and steering control, with priority given to steering control to prevent the loss of steering due to implement overload.

An object of the present invention is to provide a hydraulic control system which substantially obviates one or more of the limitations of the described prior art systems.

Another object of the present invention is to provide an efficient hydraulic control system that can be safely used for implement and steering operations on heavy off-highway vehicles.

Other objects, purposes and characteristic features of the present invention will be in part obvious from the accompanying drawing, and in part pointed out as the description of the invention progresses.

SUMMARY OF THE INVENTION

A hydraulic control system for governing steering and implement actuators is provided having separate steering and implement control valves supplied by fluid power developed by respective steering and implement pumps. Selective control valves are provided for at times interconnecting outputs of the steering and implement pumps to provide for efficient use of the fluid power available.

A pressure compensator divider is provided for delivering excess fluid power not required for steering from the steering pump to the implement control valve. An accumulator is provided as an emergency source of fluid power for operation of the steering actuator in case of failure of the steering pump. The accumulator is charged from the implement pump.

In case of failure of the steering pump, pressure differential in a passage upstream of the steering pump is sensed and in accordance therewith, delivery of fluid power through the pressure compensator divider from the steering pump to the implement control valve is terminated. Similarly fluid power of the implement pump is applied, along with pressure in the accumulator, to the steering control valve for emergency operation of the steering actuator.

For a better understanding of the present invention, together with other and further objects thereof, reference is had to the following description, taken in connection with the accompanying drawings.

With reference to the drawing, a hydraulic control system is provided for governing a steering actuator 10 and an implement actuator 11. Steering control apparatus 12 is provided for governing operation of the steering actuator 10 and similarly implement control apparatus 13 is provided for governing operation of the implement actuator 11. Fluid power input to the steering valve apparatus 12 is provided by a steering pump 14, and the implement control valve means 13 has its fluid power input primarily supplied by an implement pump 15.

The implement actuator 11 can, however, at times, receive fluid power from the steering pump 14, through a pressure compensator and divider 16 and emergency steering control apparatus 17. A sensor 18 is provided for sensing loss of fluid power in the steering pump 14, and for rendering the emergency steering control apparatus 17 effective to provide an emergency source of fluid power for the continued actuation of the steering actuator 10 after failure of the steering pump 14.

The steering control device 12 comprises a metering directional control valve 19, which, in combination with the pressure compensator and divider 16, is operable to govern the application of fluid power from the steering pump 14 to the actuator 10 in a manner disclosed in detail in the above mentioned U.S. Pat. No. 4,215,720.

The emergency steering control apparatus 17 comprises an emergency control valve 20 and an accumulator 21. The accumulator 21 is maintined pressurized from the implement pump 15, and the charging of the accumulator 21 is given preference over the supply of fluid power by the pump 15 to the implement actuator 11 because of an unloading valve device 22 included between pump 15 and the implement control valve 13.

Having thus considered the major elements of the hydraulic system according to the present invention, and their general mode of operation, the system will now be considered more in detail relative to typical operating conditions. The system is illustrated in its inactive condition, with no fluid pressure applied to the system, and with the directional control valve 19 maintained in its closed-center position. Output passage 23 of the steering pump 14 is connected to the compensating valve 16 through pressure differential switch 18, check valve 24, and passage 25. A spring 30 has actuated the spool of compensating valve 16 to its left hand position as is diagrammatically illustrated in the drawing.

Pressure as applied to the system by the steering pump 14 via passage 23, is applied to a chamber at the left hand end of the compensating valve 16 through passage 31 and restriction 32. The compensating valve 16 now moves to its right hand position and applied pressure from the supply passage 25, through a restriction 33 in the compensating valve 16 and a passage 34 to a supply port of the direction control valve 19 that is assumed to be in its closed-center position at this time. Surplus fluid power from steering pump 14 is available at this time through passage 35 of compensating valve 16, over passage 36 to an input port 37 of valve 20 and through valve 20 to the implement control valve 13 through passage 38, check valve 39, and passage 40. Excess fluid supplied to valve 13 is passed to tank T via suitable well known means.

Output of implement pump 15 is applied over passage 41, check valve 42, and passage 43 to the accumulator 21. When the accumulator 21 becomes charged, pressure in a pilot passage 44 closes the unloading valve 45 to connect the output passage 41 of the implement pump 15 to the implement control valve 13 through passage 46 in the unloading valve 45.

In accordance with the fuid circuits just described, the steering actuator 10 normally is actuated only by fluid power output of the steering pump 14, and the implement actuator 11 is normally actuated by fluid power output of the implement pump 15 plus any surplus fluid power that may be transferred via the compensator 16 from the steering hydraulic sytem which is supplied with fluid power by the steering pump 14. In case there is no excess fluid power available from the steering pump 14, the implement actuator 11 is operable solely by fluid power developed by the implement pump 15.

To consider emergency operation of the steering actuator during operation of the vehicle, it will be assumed that trouble develops in the steering pump 14, thus reducing its output pressure over passage 23. The pressure differential switch 18 senses this condition, and energizes an indicator lamp (not shown) to indicate to the operator of the vehicle that the vehicle steering system is being switched to emergency control. Also actuation of the pressure switch 18 operates a solenoid 20*a* at the left hand end of valve 20 to move the spool of valve 20 to the right, and thus terminating the connection of output from the pressure compensator 16 over passage 36 to the implement control valve 13.

Also, the operation of the spool of valve 20 to the right opens a passage 48 to connect output of accumulator 21 to the steering supply passage 25 through passages 47 and 49 and a pressure compensated flow control valve 50. The pressure compensated flow control valve 50 provides a controlled flow in the emergency steering mode so that a controlled turn of the vehicle can be made. The amount of fluid power available in the emergency steering mode, in case the prime mover has failed, depends upon the size of the accumulator and the size of the cylinders of the steering actuator 10. If only the steering pump 14 has failed, however, the implement pump 15 delivers fluid power for emergency steering continuously because of its connection to the steering passage 25 in multiple with the accumulator 21.

Check valves 24, 39 and 42 are provided to prevent backflow through the pumps, a main relief valve 51 prevents overload of pump 14 and a relief valve 52 is connected to the steering supply passage 25 as a safety device in the event that valve 20 should fail in its closed position.

Having thus described a hydraulic control system for governing implement and steering actuators as a preferred embodiment of the present invention, it is to be understood that various modification and alterations may be made to the specific embodiments shown, without departing from the spirit or scope of the invention.

What is claimed is:

1. A hydraulic control system for governing steering and implement actuators comprising steering control means and implement control means having steering and implement pump means respectively for selectively operating the steering and implement actuators, pressure compensating means for delivering excess fluid pressure from the steering control means to the implement control means, and emergency fluid pressure supply means for the steering control means, wherein improved emergency fluid pressure supply means comprises;

(a) steering control means for supplying fluid to the steering actuator from the steering pump wherein output of the steering pump is delivered successsively through a pressure sensing switch, a check valve, a pressure compensating valve for delivering excess fluid pressure from the steering control means to the implement control means and a direction control means, (b) emergency steering control means comprising;

(1) accumulator means connected through a check valve to an output supply passage of the implement pump to give charging of the accumulator means preference over pressurization of the implement actuator, (2) emergency control valve means having a solenoid control subject to energization by the pressure switch when the pressure switch senses loss of pressure in the output of the steering pump, (3) emergency control means responsive to actuation of the emergency control valve means upon energization of the solenoid for connecting output of the accumulator to input of the pressure compensating means through a pressure compensated flow control valve for pressurizing the steering control means from the implement pump, and (4) the emergency control valve being effective to prevent flow from the pressure compensating means to the implement control means as long as the solenoid remains energized.

2. A hydraulic control system for governing steering and implement actuators according to claim 1 wherein a relief valve is connected to the steering control means for overload protection in case of malfunction of the emergency steering control means.

3. A hydraulic control system for governing steering and implement actuators according to claim 1 wherein the accumulator means is charged by the implement pump means and fluid is subsequently applied to the implement control means through an unloading valve means to give preference to the charging of the accumulator means.

* * * * *